US008490328B1

(12) United States Patent
Glover

(10) Patent No.: US 8,490,328 B1
(45) Date of Patent: Jul. 23, 2013

(54) CHRISTMAS TREE STAND

(76) Inventor: George M. Glover, Brooksville, FL (US)

( * ) Notice: Subject to any disclaimer, the term of this patent is extended or adjusted under 35 U.S.C. 154(b) by 0 days.

(21) Appl. No.: 13/193,153

(22) Filed: Jul. 28, 2011

Related U.S. Application Data

(60) Provisional application No. 61/368,345, filed on Jul. 28, 2010.

(51) Int. Cl.
*A47G 33/06* (2006.01)

(52) U.S. Cl.
USPC ..... 47/40.5

(58) Field of Classification Search
USPC ..... 47/40.5
See application file for complete search history.

(56) References Cited

U.S. PATENT DOCUMENTS 2,913,202 A * 11/1959 Meldrum ..... 47/40.5
3,073,558 A * 1/1963 De Klotz ..... 47/40.5
3,136,514 A * 6/1964 Rzepela ..... 47/40.5
4,190,983 A * 3/1980 Rostomily ..... 47/40.5
5,249,772 A * 10/1993 Montie et al. ..... 248/523
7,341,234 B2 * 3/2008 Kowalski ..... 248/523
7,484,703 B2 * 2/2009 Krinner ..... 248/519
7,618,022 B2 * 11/2009 Thurner ..... 254/223
2006/0168878 A1 * 8/2006 Brandes ..... 47/40.5
2007/0012851 A1 * 1/2007 Krinner ..... 248/524

* cited by examiner

*Primary Examiner* — Monica Williams
*Assistant Examiner* — Timothy Schwartz
(74) *Attorney, Agent, or Firm* — Ronald E. Smith; Smith & Hopen, P.A.

(57) ABSTRACT

A Christmas tree stand includes a water-retaining pan and a plurality of legs for holding the pan. The radially inner end of each leg terminates in an upwardly extending tree stabilizer. A split ring is secured to the radially outward side of each tree stabilizer and the split rings collectively hold a cable that is disposed in surrounding relation to the tree after the tree is centered in the pan. A circular plate is centered on the bottom of the pan and has an upstanding sidewall mounted about its periphery. A disc fits atop the circular plate and an upstanding screw is secured to the center of the disc. Manual rotation of the disc advances the screw into the bottom of the tree trunk. The disc and tree trunk are guided into overlying relation to the circular plate and the cable is brought into encircling relation to the tree trunk.

6 Claims, 3 Drawing Sheets

CHRISTMAS TREE STAND

CROSS-REFERENCE TO RELATED APPLICATION

This is a non-provisional application of provisional application No. 61/368,345 of the same title filed on Jul. 28, 2010 by the same inventor and claims priority thereto. Said provisional application is incorporated herein by reference.

BACKGROUND OF THE INVENTION

1. Field of the Invention

This invention relates, generally, to stands for holding trees. More particularly, it relates to a Christmas tree stand that does not require that the lower branches of a tree be removed prior to placing the tree in the stand.

2. Description of the Prior Art

A well-known conventional Christmas tree stand includes a water-retaining pan that is held in upwardly spaced relation to a floor by a plurality of leg members. A metal ring is spaced several inches above the bottom of the pan that holds the base of the tree. Typically, the bottom of the pan includes several upstanding, sharp pieces of metal secured to the center of the pan upon which the base of the tree is deposited when mounting a tree in the stand. The bottom of the trunk is punctured by the sharp pieces of metal and the ring surrounds the tree trunk a foot or so above the bottom of the pan so that the tree is held in a vertical orientation. Radially inwardly directed screws extend through the ring to further stabilize the tree.

The presence of the metal ring requires that the lower branches of the tree be cut off. Sometimes the best, fullest branches of the tree are the lower branches.

Thus there is a need for a tree stand that does not require the ring so that the lower branches of a tree need not be removed.

However, removal of the ring removes support from the tree, allowing it to fall over.

The sharp metal pieces that extend upwardly from the bottom of the pan are also hazardous.

Thus, there is also a need for a Christmas tree stand that is free of such sharp metal projections.

However, in view of the art considered as a whole at the time the present invention was made, it was not obvious to those of ordinary skill in the art how the needed stand could be provided.

SUMMARY OF THE INVENTION

The long-standing but heretofore unfulfilled need for an improved tree stand is now met by a new, useful, and non-obvious invention. The novel structure includes a water-retaining pan and a plurality of circumferentially and equidistantly spaced apart legs adapted to hold the pan in a level orientation in spaced apart relation above a floor.

An upwardly extending tree stabilizer is secured to a radially innermost end of each of the legs.

A circular plate is centered on a bottom wall of the pan and an upstanding sidewall is mounted about the periphery of the circular plate.

A disc has a screw secured thereto in upstanding relation to the disc, centrally thereof. The screw is adapted to screw-threadedly engage a flat bottom of a trunk of a tree. The disc is disposed in abutting relation to the flat bottom when the screw is fully advanced and the disc is disposed in overlying relation to the circular plate when the screw is fully advanced.

A cable is disposed in encircling relation to the tree stabilizers to help maintain the tree in upstanding orientation relative to the floor.

A cable-securing means is secured to a radially outward side of each tree stabilizer. A first end of the cable is secured to a preselected tree stabilizer and an elongate tubular member is secured to the preselected tree stabilizer. An elongate externally threaded screw is disposed though a hollow bore of the elongate tubular member. A second end of the cable is welded to a head of the screw and a nut is disposed in screw-threaded engagement with the head of the screw so that turning the nut tightens the cable around the tree trunk.

A plurality of tabs is secured to a top edge of the sidewall in circumferentially spaced apart relation to one another. Each tab is bent radially outwardly to help guide a tree trunk when a tree is being centered atop the circular plate.

A plurality of dish-shaped concavities is formed in the periphery of the disc to facilitate gripping of the disc about its periphery so that manual rotation of the disc causes the screw to enter into the flat bottom of the tree trunk.

The primary object of the invention is to provide a tree stand that does not require that the lowermost branches of the tree be removed as a prerequisite to entry of the tree into the stand.

A closely related object is to provide a tree stand that is free of the prior art ring that facilitates stabilization of the tree but requires removal of the lowermost branches.

These and other important objects, advantages, and features of the invention will become clear as this description proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENT

Figure 1:
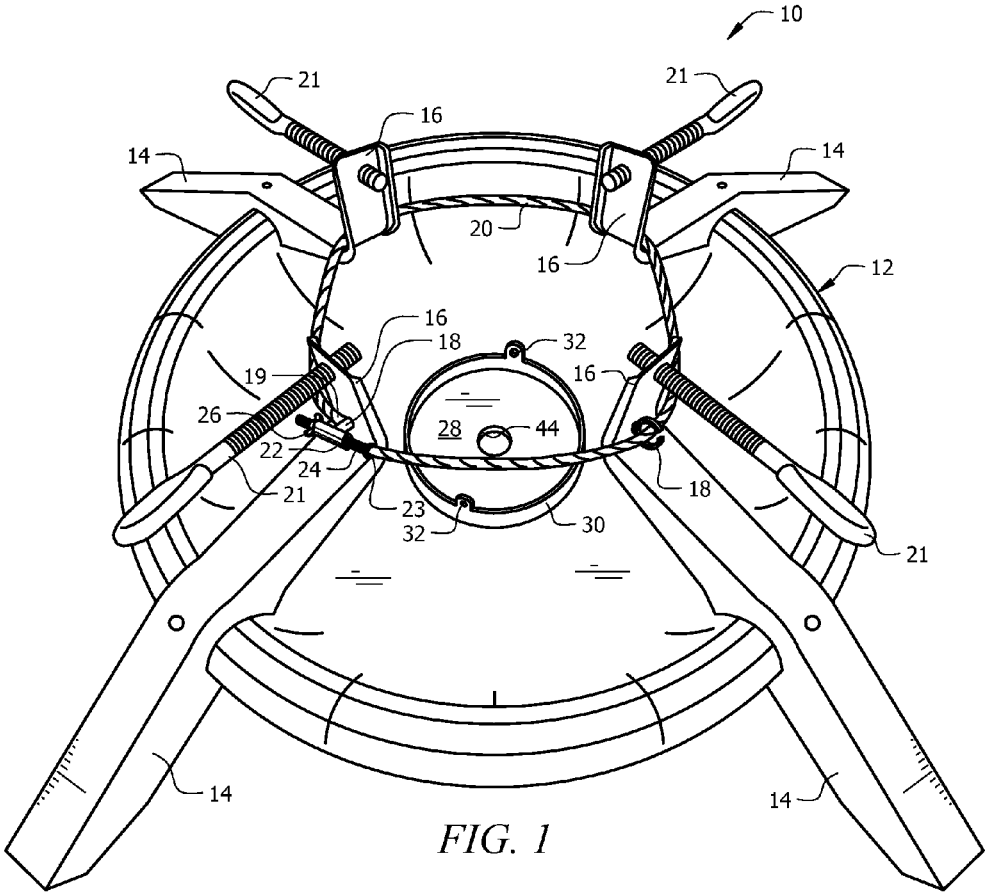
FIG. 1 is a perspective view of the novel stand.

FIG. 1 depicts an illustrative embodiment of the novel Christmas tree stand which is denoted as a whole by the reference numeral 10.

Stand 10 includes water-retaining pan 12 and four (4) circumferentially and equidistantly spaced apart legs, collectively denoted 14, for holding pan 12 in a substantially level orientation in vertically spaced apart relation to a floor, not shown. As few as three (3) individual legs are within the scope of this invention. A legless or pedestal-supported stand is also within the scope of this invention because the means for supporting pan 12 in a generally level plane is not an important or critical part of the invention.

Radially inner end 16 of each leg 14 is bent upwardly to form a tree stabilizer that extends for an inch or more along the extent of a tree held by novel stand 10. A split ring 18 is welded or otherwise secured to the radially outward side of each tree stabilizer 16 near its juncture with its associated leg 14. In a prototype of the invention, cable 20 is extended through all of the rings but one (1) after a tree has been centered in the pan in an upstanding orientation so that the cable surrounds the tree. The one (1) split ring that does not receive a cable, hereinafter referred to as the mounting ring, is used as a mounting means for a mechanism, hereinafter disclosed, that is used to tighten cable 20 after a tree is fully secured within novel stand 10.

A first end 19 of cable 20 is welded or otherwise secured to a preselected leg 16 to which said mounting ring is secured. One advantageous way to secure first end 19 of cable 20 is to form an aperture in that preselected leg and to extend first end 19 of cable 20 through that aperture and to thereafter enlarge said first end by suitable means such as soldering or welding so that it cannot be retracted through said aperture.

In the prototype, elongate tubular member 22 is secured by suitable means such as welding to the mounting ring and elongate externally threaded screw 24 is inserted through the hollow bore of said tubular member. A second end 23 of cable 20 is welded or otherwise secured to the head of screw 24 and nut 26, preferably a wing nut as depicted, engages the free end of screw 24 so that turning wing nut 26 tightens cable 20 around tree 50.

Split rings 18 need not be split but the use of split rings avoids threading cable 20 through the respective eyes of solid rings.

Each tree stabilizer 16 has an aperture formed therein near its uppermost end for the reception of a conventional, radially disposed screw 21 that when turned supports the tree in a well-known way.

Circular plate 28 is centered on the bottom of pan 12. It has an upstanding sidewall 30 mounted about its periphery and two or more tabs 32 are secured to or integrally formed with the top edge of sidewall 30 in circumferentially spaced apart relation to one another. Tabs 32 are bent radially outwardly to help guide a tree trunk when a tree is being placed into stand 10.

Figure 2:
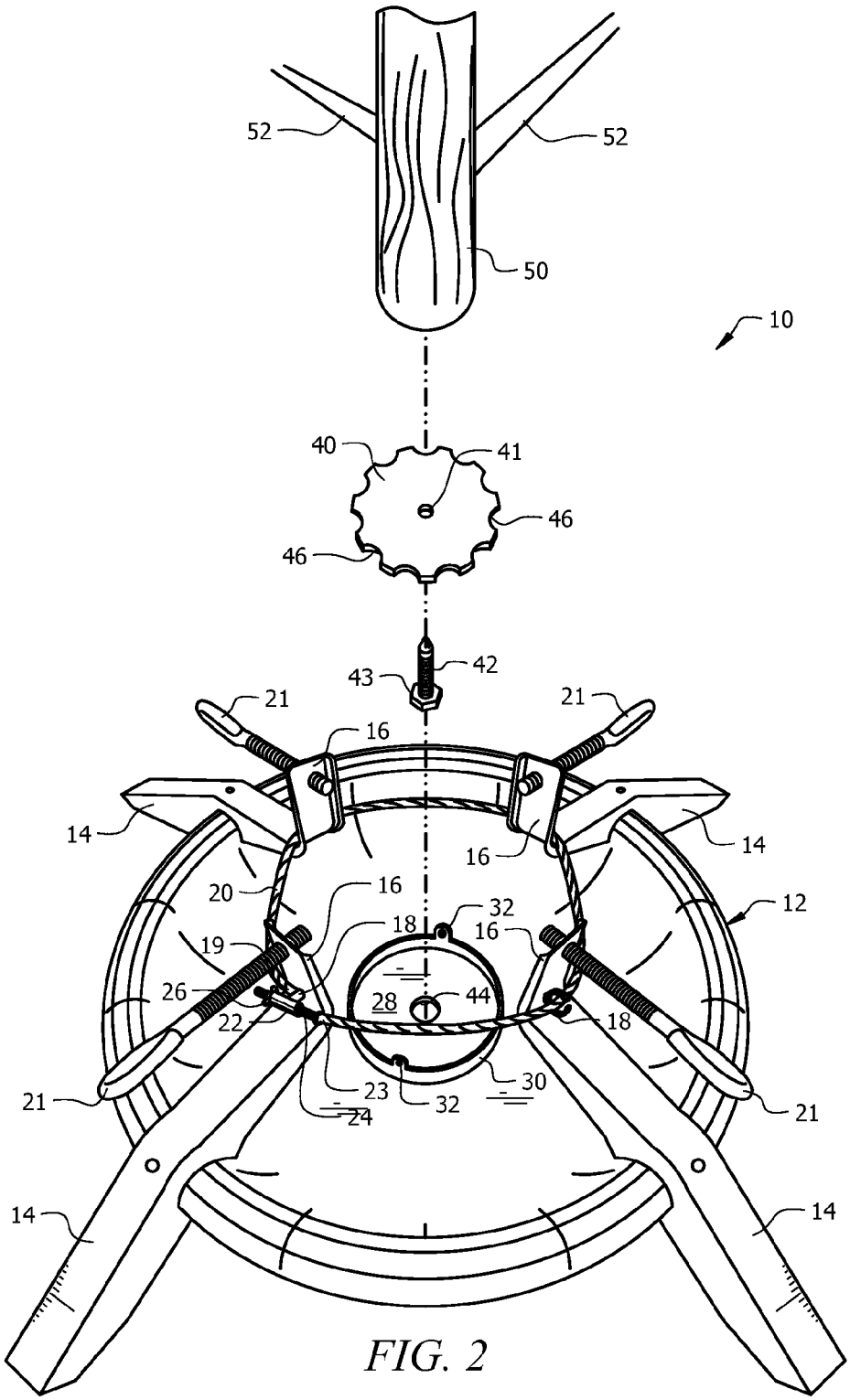
FIG. 2 is an exploded perspective view.

As perhaps best understood in connection with FIGS. 1 and 2, disc 40 is sized to fit atop circular plate 28. Sidewall 30 serves to center disc 40 atop said circular plate. Disc 40 is centrally apertured as at 41 to receive the threaded stem of screw 42 therethrough. Head 43 of screw 42 does not extend through aperture 41; it abuts the underside of circular plate 28.

A plurality of dish-shaped concavities, collectively denoted 46, are formed in the periphery of disc 40. These concavities facilitate gripping of disc 40 about its periphery so that manual rotation of disc 40 causes screw 42 to enter into the bottom of tree trunk 50 as best understood in connection with FIG. 3.

As depicted in FIG. 2, circular plate 28 has central aperture 44 formed therein to accommodate head 43 of screw 42 when tree 50 is installed. Both screw head-accommodating central aperture 44 and head 43 of screw 42 could be eliminated by welding the threaded stem of screw 42 to the center of disc 40 so that rotation of disc 40 drives said threaded stem 42 into the bottom of the trunk of tree 50 as aforesaid.

Figure 3:
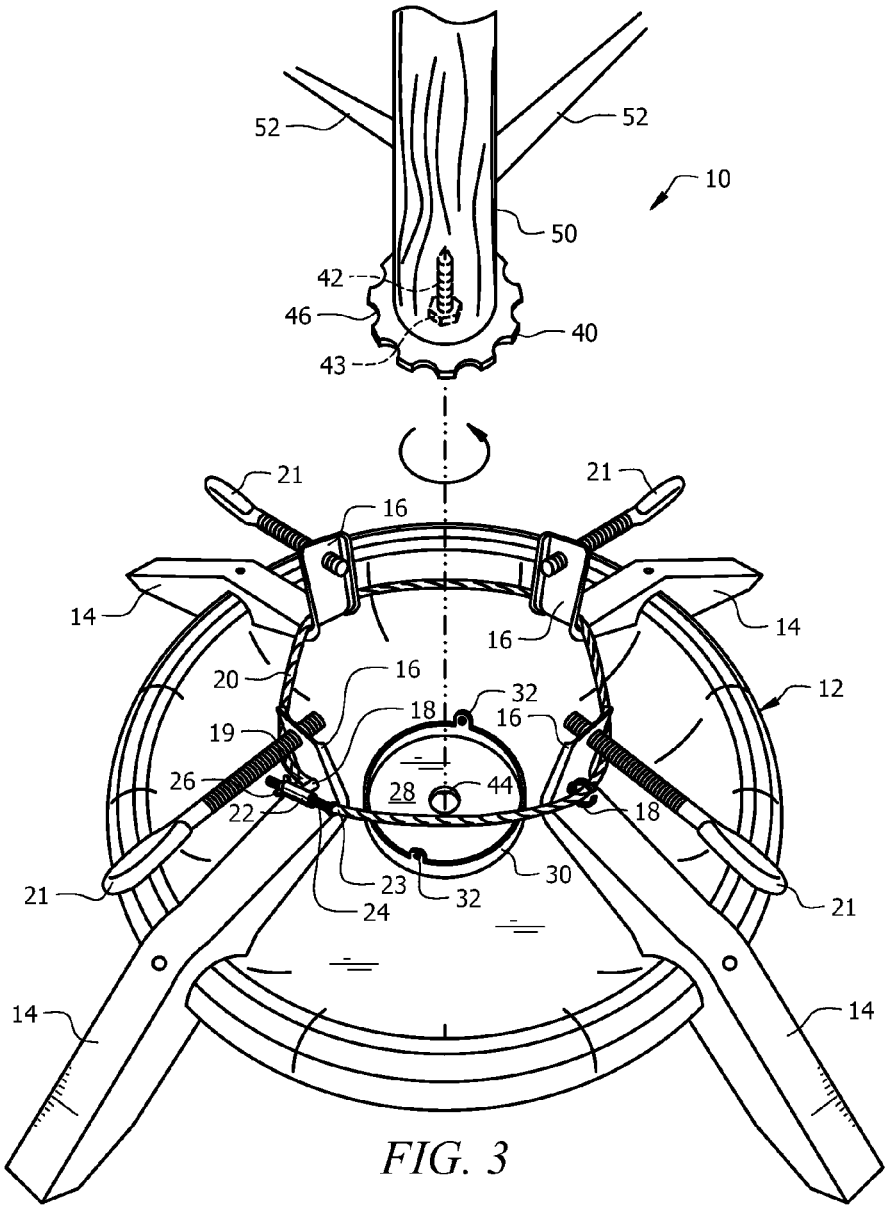
FIG. 3 is an exploded perspective view.

After screw 42 has fully entered into the bottom of tree trunk 50 and disc 40 is therefore disposed in tightly abutting relation to the flat bottom of said tree trunk as depicted in FIG. 3, disc 40 and hence the tree trunk are guided into overlying relation to circular plate 28, tabs 32 serving to help center the trunk as it is inserted. Cable 20 is then brought into encircling relation to the tree trunk in the manner already described and said cable is tightened to finish the job. Significantly, low branches 52 need not be trimmed because the metal ring of the prior art stand that required such trimming is eliminated.

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A stand for a tree, comprising:

a water-retaining pan having an annular rim;

a plurality of circumferentially and equidistantly spaced apart legs adapted to hold said pan in a level orientation in spaced apart relation above a level floor;

each leg of said plurality of legs having a radially outward end adapted to abut and overlie said floor;

each leg of said plurality of legs having a radially inward end disposed in a vertical plane when each leg abuts said level floor;

each leg of said plurality of legs being disposed in overlying and abutting relation to said rim at a point between said radially outward and radially inward end of each leg;

a cable disposed in encircling relation to said radially inward ends a first end of said cable being secured to a preselected radially inward end;

an elongate tubular member secured to the preselected radially inward end to which said first end of said cable is secured;

an elongate externally threaded screw disposed though a hollow bore of said elongate tubular member;

a second end of said cable secured to a head of said screw;

a nut disposed in screw-threaded engagement with screw threads of said screw so that turning said nut tightens said cable and hence said radially inward ends around said tree trunk;

said cable being spaced apart from a tree positioned in said stand.

2. The stand of claim 1, further comprising:

a circular plate centered on and secured to a bottom wall of said pan;

an upstanding sidewall mounted about the periphery of said circular plate;

a rigid disc;

said upstanding sidewall being of truncate extent, said truncate extent being only slightly greater than a thickness of said rigid disc so that said rigid disc may be surrounded and secured against movement by said truncate sidewalls;

a screw secured in upstanding relation to said disc, centrally thereof, said screw adapted to screw-threadedly engage a flat bottom of a trunk of a tree, said disc being disposed in abutting relation to said flat bottom when said screw is fully advanced and said disc being disposed in overlying relation to said circular plate when said screw is fully advanced;

a cable-securing means secured to a radially outward side of each radially inward end;

each cable-securing means having an annular configuration so that said cable may extend therethrough.

3. The stand of claim 2, further comprising:

said cable extending through all of said cable-securing means except one;

a first end of said cable being secured to a radially outward side of a preselected radially inward end, said preselected radially inward end having the cable-securing means through which the cable does not extend.

4. The stand of claim 1, further comprising:

an aperture formed in each radially inward end near an uppermost end thereof;

a plurality of radially disposed screws that screw-threadedly engage an associated aperture so that advancement of said screws causes a leading end of each screw to abut said tree trunk to thereby further support said tree in said stand.

5. The stand of claim 1, further comprising:

a plurality of tabs secured to a top edge of said sidewall in circumferentially spaced apart relation to one another;

each tab of said plurality of tabs being bent radially outwardly to help guide a tree trunk when a tree is being centered atop said circular plate.

6. The stand of claim 1, further comprising:

a plurality of dish-shaped concavities formed in the periphery of said disc to facilitate gripping of said disc about its periphery so that manual rotation of said disc causes said screw to enter into said flat bottom of said tree trunk.

* * * * *